US005082203A

United States Patent [19]

Baubry

[11] Patent Number: 5,082,203

[45] Date of Patent: Jan. 21, 1992

[54] SYSTEM FOR THE OPENING OF AN UNFOLDING TAIL UNIT FOR PROJECTILES

[75] Inventor: Bernard Baubry, Paris, France

[73] Assignee: Thomson-Brandt Armements, Boulogne Billancourt, France

[21] Appl. No.: 496,221

[22] Filed: Mar. 20, 1990

[30] Foreign Application Priority Data

Mar. 24, 1989 [FR] France ..... 8903924

[51] Int. Cl.[5] ..... F42B 13/32

[52] U.S. Cl. ..... 244/3.28

[58] Field of Search ..... 244/3.26–3.3

[56] References Cited

U.S. PATENT DOCUMENTS

| | | | |
|---|---|---|---|
| 2,801,587 | 8/1957 | Gould . | |
| 2,821,924 | 2/1958 | Hansen et al. . | |
| 3,196,793 | 7/1965 | Milenkovic et al. . | |
| 3,304,030 | 2/1967 | Weimholt et al. . | |
| 3,944,168 | 3/1976 | Bizien et al. | 244/3.28 |
| 4,262,862 | 4/1981 | Hutter . | |
| 4,702,436 | 10/1987 | Arnell | 244/3.28 |

FOREIGN PATENT DOCUMENTS 1152013 6/1956 France .

*Primary Examiner*—Mark Hellner
*Attorney, Agent, or Firm*—Oblon, Spivak, McClelland, Maier & Neustadt

[57] ABSTRACT

According to the invention, the system should reliably provide for the complete and irreversible unfolding of the fins of the tail unit, after the departure of the projectile, and should enable the triggering, after the locking of the fins, of an ignition device for the propulsion unit contained in the projectile. A system for opening an unfolding tail unit for projectiles provided with a propulsion unit, formed by a plurality of fins hinged on shafts and distributed around the projectile, comprises a part capable of sliding imperviously from a first position to a second position in a first bore, so as to drive means for pivoting the fins. With the first bore, this part defines a first chamber and can be shifted by gas pressure in this chamber, generated by a gas generator, the fins being completely unfolded during the shifting of the part towards the second position. The opening system also includes a closing means fixed to the sliding part making it possible, before it has reached the second position, to isolate the first chamber from a second chamber and prevent the triggering of an ignition device for the propulsion unit under the effect of a pressure.

13 Claims, 4 Drawing Sheets

SYSTEM FOR THE OPENING OF AN UNFOLDING TAIL UNIT FOR PROJECTILES

BACKGROUND OF THE INVENTION

1. Field of the Invention

The present invention concerns a combined opening system for the fins of an unfolding tail unit for projectiles, notably munitions for mortars, provided with a propulsion unit.

2. Description of the Prior Art

For a great variety of reasons, it may be necessary, or at least preferable, to have a tail unit with a span that is greater than the gauge at the rear of a munition. These reasons include a great length of the munition, the optimization of precision, the presence of a propulsion unit to increase the range etc. As a rule, a tail unit of this kind will advantageously be designed to be capable of taking a folded position at rest to make it fit into the gauge in order to reduce the space factor of the munitions and make it easier to handle and stow them. For munitions designed to be launched with a weapon, this ability to be folded becomes a necessity, to enable the munition to be introduced into the gun.

This type of tail unit, commonly called an unfolding tail unit, is formed by a plurality of fins arranged around the munition. Their opening should meet three essential requirements: first of all, it should be triggered after the munition leaves, to preserve the fins against shocks. Secondly, the unfolding should be complete and irreversible because of the major influence of a fin such as this on the trajectory of the munition. Finally, the propulsion unit positioned inside the projectile should be triggered only after the total and irreversible opening of the tail unit. This feature thus forms a safety device for a projectile provided with a propulsion unit.

An object of the present invention is provide for a system for the combined opening of the fins of an unfolding fin which is simple and meets these three requirements in a dependable way.

For a munition designed to be launched with a weapon, advantageously a pressure-sensitive time-delayed igniter will be used. This igniter will be triggered by the pressure inside the gun at the firing instant, the time-delay being greater than the munition ejection time.

SUMMARY OF THE INVENTION

According to the invention, there is provided a system for opening an unfolding tail unit for a projectile formed by a plurality of fins hinged on shafts and distributed around the projectile, including a part capable of sliding in an imperviously sealed manner from a first position to a second position in a first bore so as to drive means for pivoting fins, said part defining a first r with the first bore and being movable by the pressure of a gas in this first chamber, generated by a gas generator, the fins being completely unfolded during the shifting of the part towards the second position, a system comprising a closing means fixed on the sliding part, making it possible, before it has reached the second position, to isolate the first chamber from a second chamber with respect to a device for igniting the propulsion unit that gets triggered under the effect of a pressure.

BRIEF DESCRIPTION OF THE DRAWINGS

The invention will be understood more clearly from the following description and from the appended drawings, of which.

DESCRIPTION OF A PREFERRED EMBODIMENT

Figure 1:
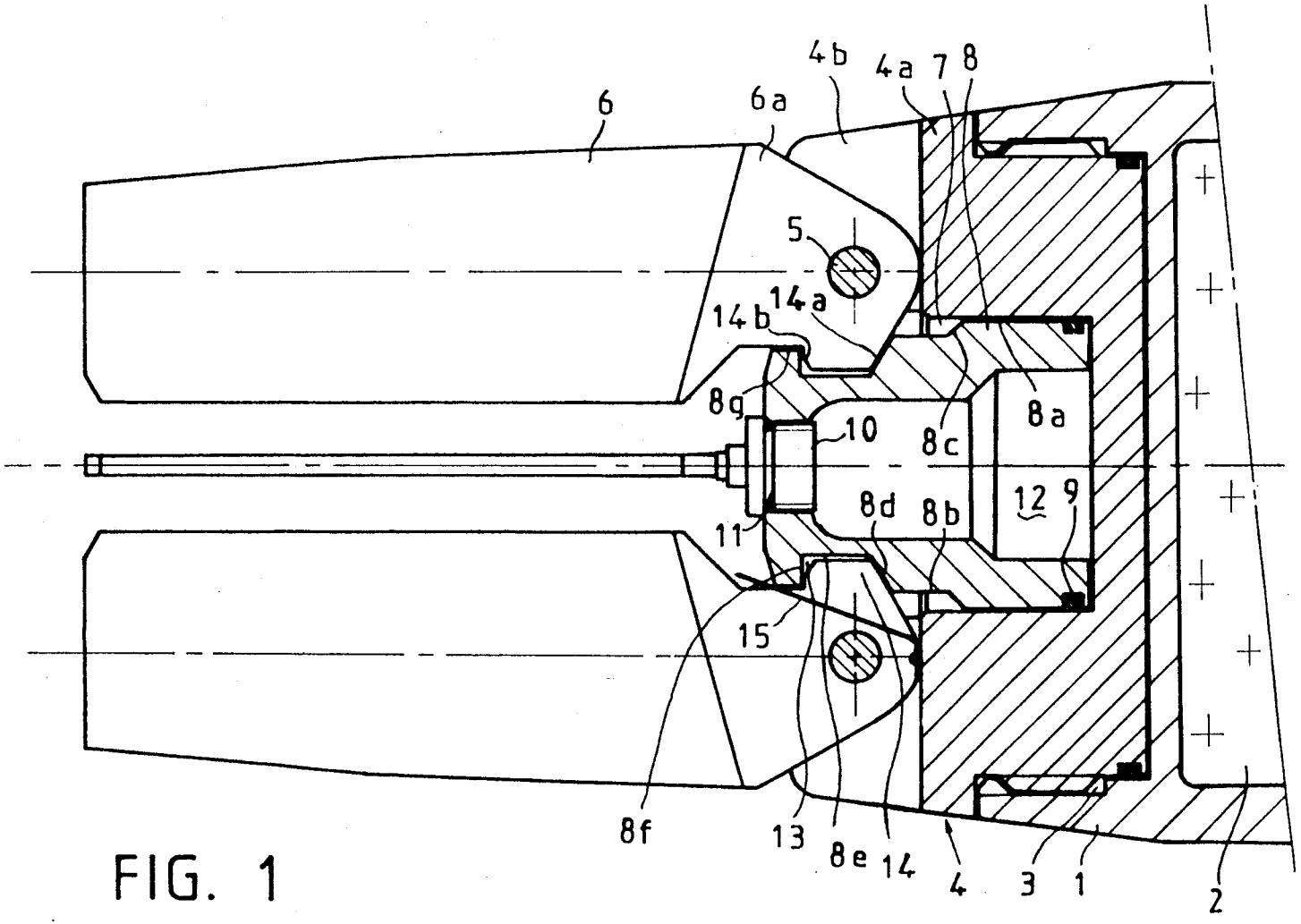
FIG. 1 (PRIOR ART)
FIG. 1 is an axial sectional view of the rear of a munition having a tail unit in folded position provided with an opening system based on a system known in the prior art.
Figure 2:
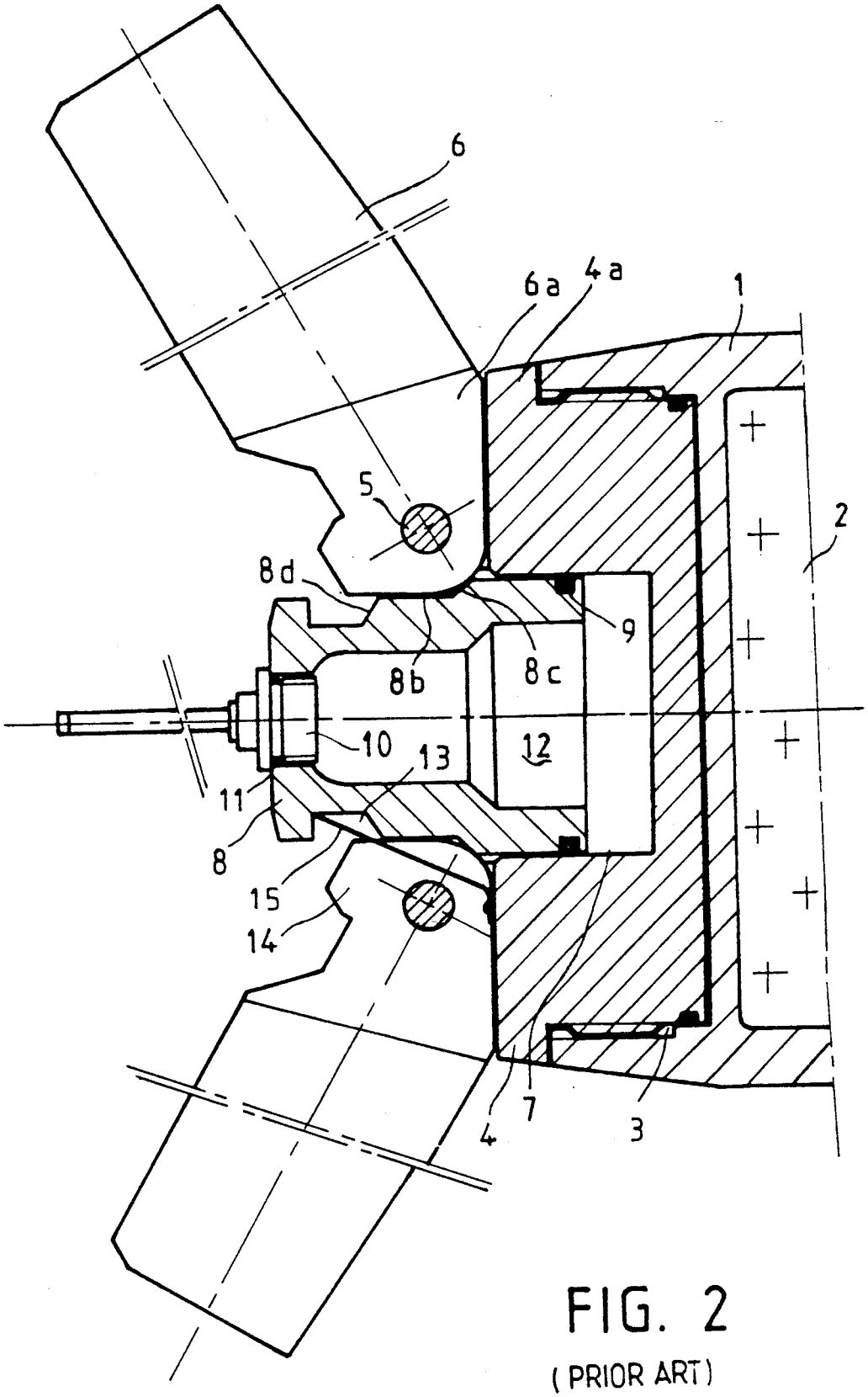
FIG. 2 (PRIOR ART)
FIG. 2 is a view similar to that of FIG. 1, but showing the unfolded tail unit.

The projectile with its rear part shown partially in FIGS. 1 and 2 is a munition without self-propulsion, for example a munition which is launched with mortars.

The body 1 of the munition, which is in one or more sections, encloses active elements such as an explosive charge 2. The rear end of the body 1 has a tapped axial bore 3 into which there is screwed a block 4 formed by a threaded cylindrical part **4*a* and a rear part consisting of radial plates 4*b* that are fixedly joined to the part 4*a* and evenly distributed around the longitudinal axis X—X. Each plate 4*b* bears a perpendicular shaft 5 on which there is hinged the base 6*a* of a fin 6**. Although, for reasons of clarity, the drawings show a tail unit with four fins, there are more commonly six or eight of these fins, this number being determined by or for aerodynamic reasons.

The part **4*a* of the block 4 has a first axial bore 7 opening between the plates 4*b*. A rotating part 8 is mounted in a sliding position in this axial bore 7. A seal 9 surrounds the base of the part 8, to provide for imperviousness between this part 8 and the wall of the bore 7**.

The part 8 has a general shape of a bell with its top having a tapped hole in which a pyrotechnical assembly 10 is imperviously fixed by means of a seal 11. This pyrotechnical assembly 10 is provided with a pressure-sensitive time-delayed igniter. The function of the assembly 10 is to generate a gas under pressure in a sealed chamber 12 demarcated by the interior of the part 8 and the bottom of the bore 7.

From the base to the top, the external wall of the part 8 forms a first cylindrical part **8*a* which closely fits the shape of the wall of the bore 7, a second cylindrical part 8*b* with a smaller diameter, separated from the part 8*a* by a truncated shoulder 8*c*, and a groove 13, of which the front edge is a truncated shoulder 8*d*, the bottom is a cylindrical part 8*e* and the rear edge is a shoulder 8*f* perpendicular to the axis X—X, followed by a cylindrical end part 8*g*. In said groove, there is engaged a tooth 14 formed at the rim of the base 6*a* of each fin 6**.

In FIG. 1, which shows the fins folded and the part 8 at the bottom of the bore 7, it can be clearly seen that each tooth 14 has a shape that substantially matches the contour of the groove 13 so as to enter it. The tooth 14 forms a projection on the internal side of the base part **6*a*, its front side 14*a* being in the extension of the front side of the part 6*a***.

In their folded position (FIG. 1), so long as the part 8 is still, the fins 6 are prevented from pivoting outwards by a sharp-edged part of their rear side **14*b* which abuts the shoulder 8*f*. Their inward pivoting is prevented by the fact that the part of the internal side of the base 6***a* behind the tooth 14 rests on the end cylindrical part 8*g*. It must be noted that a safety system may be provided to keep the part 8 still in the bore 7 before the system goes into operation. This safety system would consist of a shearing stud, which is not shown, engaged in aligned radial bores in the cylindrical wall 8*a* and the wall of the bore 7. We might also indicate a device for the mechanical protection of the fins, consisting of a spacer placed axially behind the part 8 and bearing radial shutters that are wider than the fins, said device remaining in the weapon when the munition is launched.

FIG. 2 shows the fins 6 in a fully unfolded state: the external side of their base part 6*a* is applied against the bottom of the cylindrical part 4*a* of the block 4, while the front side is applied to the cylindrical surface 8*a* of the part 8 which has left the bottom of the bore 7 under the effect of a gas pressure generated in the chamber 12 by the device 10. It must be noted that, in this position, the part 8 is rearwardly blocked by the fact that the shoulder 8*c* abuts the base part 6*a* of the fins. Furthermore, the seal 9 at the rim of the part 8 is still in contact with the internal wall of the bore 7, so that the pressure is maintained in the chamber 12 and prevents the return of the part 8 towards the bottom of the bore. The fins 6 are thus completely blocked between the two perpendicular surfaces formed by the bottom of the part 4*a* and the surface 8*b*. It will be noted, from the drawings, that the full unfolding is achieved irreversibly as soon as the external edge of the shoulder 8*d* reaches the level Of the axis 5, namely before the part 8 has reached its farthest rear position.

Although the part 8 is normally blocked when it reaches it farthest rear position by the sole fact that the pressure is maintained in the chamber 12, an additional safety system may consist of one or more flexible strips 15, fixed to the bottom of the block 4 and providing for the mechanical blocking of the part 8, by bracing up the groove 13, FIG. 2.

During operation, the projectile is introduced into a weapon, preferably provided with a device for the protection of the fins as mentioned earlier, the fins 6 being in the position of FIG. 1, namely within the gauge. At the firing instant, the pressure in the gun of the weapon triggers the time-delayed igniter of the pyrotechnical assembly 10, the time-delay of which is chosen in such a way that the pressure is set up in the chamber 12 only after the munition has left the mouth of the gun. Under the effect of said pressure, the part 8 is then driven irreversibly until the above-described position of FIG. 2.

Naturally, the seals 9 and 11 providing for the imperviousness of the chamber 12 should be chosen so as to be sufficiently resistant to stand up to the conditions of temperature and pressure inside the gun. In practice, butadiene-acrylic seals prove to be satisfactory.

Figure 3:
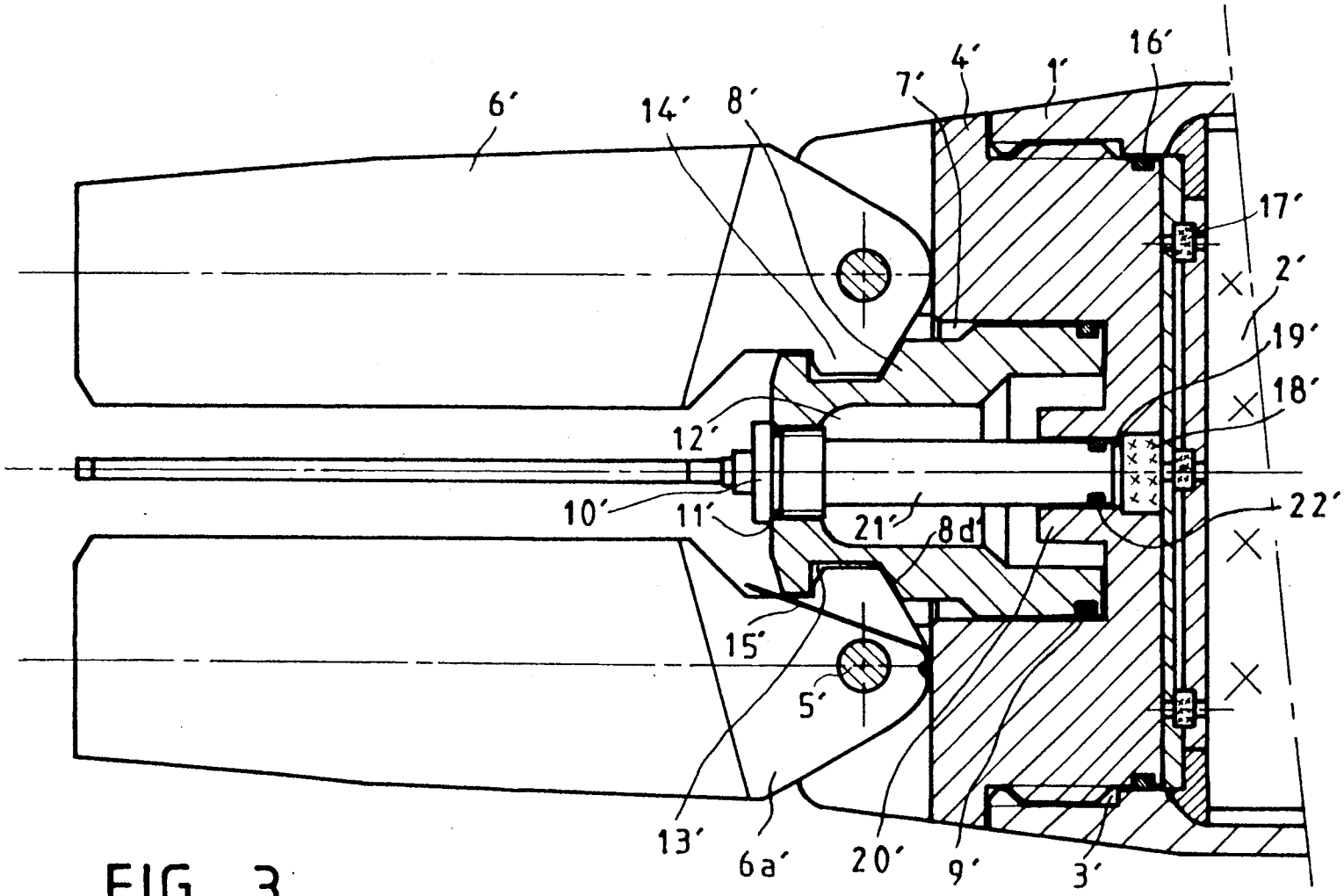
FIGS. 3 and 4 are the same views as FIGS. 1 and 2 respectively, but illustrate an opening system according to the invention for munitions with auxiliary propulsion.
Figure 4:
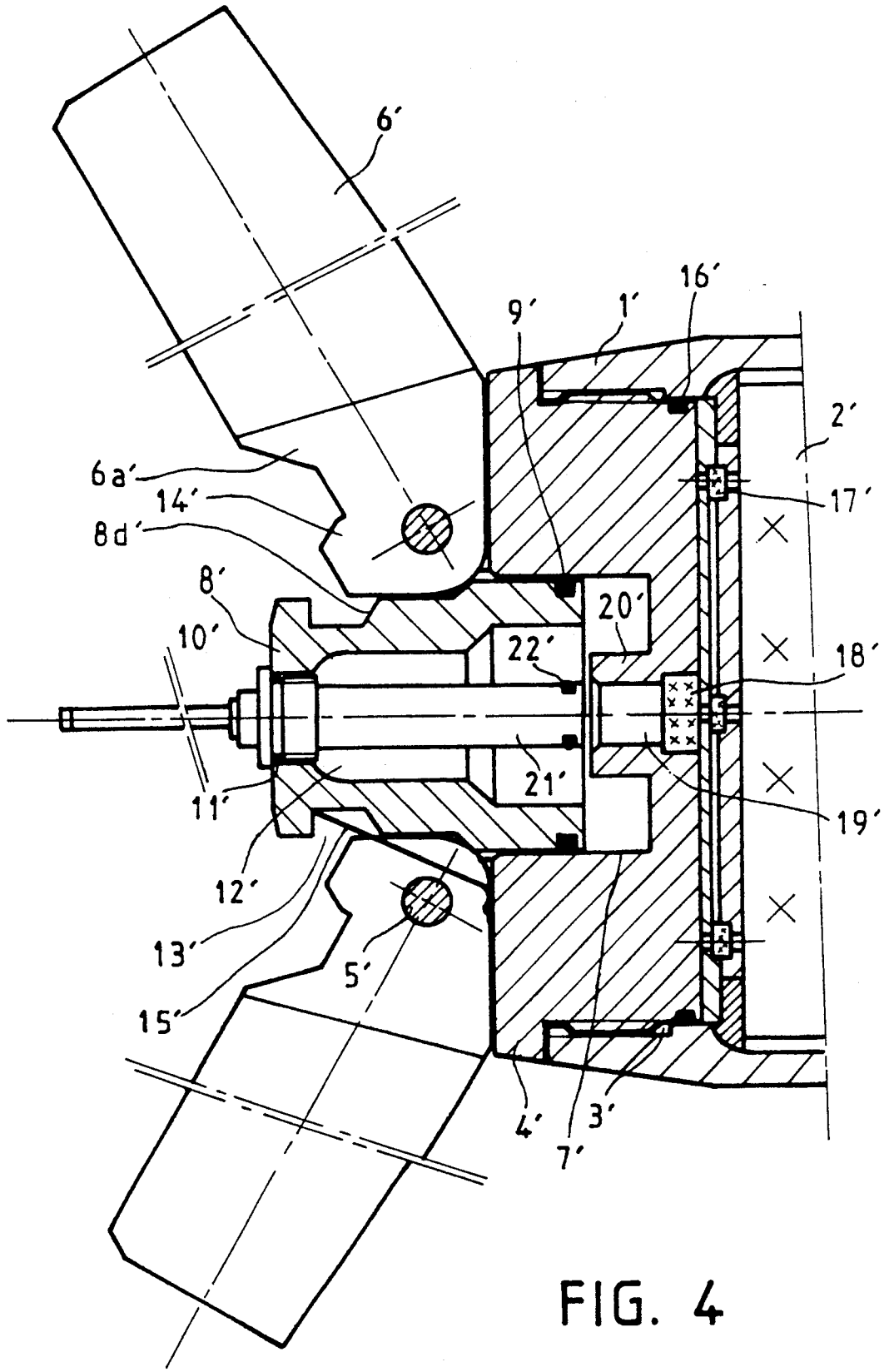

The opening system according to the invention, shown in FIGS. 3 and 4, designed for a projectile provided with a propulsion unit, has the same elements working in the same way as those of the system of FIGS. 1 and 2 and, for this reason, they shall not be described again in detail herein and shall be designated by the same numerical references together with the sign ′.

The body 1′, in which the block 4′ is imperviously fixed by means of a seal 16′, is the rear part of a section of munition enclosing fuel 2′ designed for propulsion. This propulsion is provided by means of nozzles, not shown, that go through the block 4′ and open out between the fins 6′. To enable the starting of the propulsion unit, an ignition device is formed, for example, by several igniters 17′ evenly distributed on the base of the fuel 2′, contained within the propulsion unit, and a pyrotechnical relay 18′ providing for the firing of the igniters 17′.

According to the invention, the relay 18′ is at the end of a second chamber, for example a bore 19′, the other end of which opens out into the bore 7′. In the exemplary embodiment shown, the bore 19′ is coaxial with the bore 7′, and it extends to some extent into this bore 7′, in a ring-shaped part 20′.

Furthermore, the part 8′, engaged in the bore 7′ and providing for the pivoting of the fins 6′, is provided internally with a cylindrical axial rod 21′ that is fixed to the bottom of the part 8′ and has its free end substantially in the same plane as its base edge inside the bore 7′. The rod 21′ has the same diameter as the bore 19′, so that it is capable of being closely and imperviously engaged therein by means of a seal 22′. The rod 21′ and the seal 22′ thus form a means for closing the second chamber 19′. Thus in FIG. 3, which shows the part 8′ at the bottom of the bore and the fins 6′ in folded position, the rod 21′ is engaged in the bore 19′ so that there is no communication between the chamber 12′ and that part of the bore 19′ which is open on the relay 18′.

In FIG. 4, the part 8′ is in the farthest rear position, the fins 6′ being unfolded. The free end of the rod 21′ has come out very slightly from the bore 19′, so that the chamber 12′ now communicates with it.

During operation, the end of the rod 21′ leaves the bore 19′ after the fins have been completely and irreversibly unfolded, namely, as can be seen from the drawings, after the external edge of the shoulder 8*d*′ has reached the level of the shaft 5′. Consequently, the pressure in the chamber 12′ is transmitted to the relay 18 to trigger it only after the fins 6′ have been blocked in unfolded position.

It will be noted here that the gases intended for the propulsion may penetrate the chamber 12′ through the bore 19′. It is therefore important for the seals 9′ and 11′ to play their role to the full extent in order to prevent leaks which may be detrimental to the efficiency of the propulsion unit and, consequently, detrimental to firing precision. As in the previous case, one or more flexible strips 15′ may be fixed to the bottom of the block 4′ to provide for an additional, mechanical blocking of the part 8′ in the rear position.

The device of the invention has the advantage of being mechanically simple and, consequently, reliable and easy to implement. While it is particularly well suited to the type of munitions designed for mortars, it can equally well be applied to all types of projectiles, it being necessary to change or modify only the time-delayed igniter used to set up the pressure of unfolding of the fins, acccording to the type of triggering that may be used, for example electronic triggering. Furthermore, if desired, the system of the invention could be easily provided with an additional safety system designed to maintain the munition in the inert state until the total unfolding of the fins. This additional safety system could take the form of an electrical contactor in an electrical circuit for the activation of the munition, the contactor being closed by the part 8 or 8′ when it reaches its farthest rear position.

What is claimed is:

1. A system for opening an unfolding tail unit for a projectile comprising a propulsion unit and formed by a plurality of fins hinged on shafts and distributed around the projectile, including a part capable of sliding in an imperviously sealed manner from a first position to a second position in a first bore so as to drive means for pivoting fins, said part defining a first chamber with the first bore and being movable by the pressure of a gas in this first chamber, generated by a gas generator, the fins being completely unfolded during the shifting of the part towards the second position, said system comprising a closing means fixed on the sliding part, making it possible, before said sliding part has reached the second position, to isolate said first chamber from a second chamber comprising an ignition device for igniting the propulsion unit that gets triggered under the effect of a pressure, and once said second position has been reached, to put said first chamber in communication with said second chamber.

2. An opening system according to claim 1, wherein the closing means include an axial rod fixed to the bottom of the part and a seal positioned around the rod so that is rod is imperviously engaged in the second chamber.

3. An opening system according to claim 1, wherein the projectile is to be launched with a weapon and the gas under pressure in said first chamber is generated by a pyrotechnical assembly provided with a pressure-sensitive time-delayed igniter, the time-delayed igniter being then triggered by the pressure in the weapon during the firing.

4. An opening system according to claim 1, wherein said ignition device is formed by several igniters evenly distributed at the base of a fuel contained inside said propulsion unit and a pyrotechnical relay providing for the firing of the igniters.

5. An opening system according to claim 1, wherein said second chamber is formed in a second axial bore at the bottom of the first bore, of which the part opening out on the ignition device for the starting of the propulsion unit is isolated from the first chamber by the rod which is fixedly joined to the part and imperviously engaged in the second bore, so long as the part is not about to reach its second position.

6. An opening system according to claim 1, wherein said first bore is positioned in a block located at the rear of the projectile.

7. An opening system according to claim 1, wherein said second position of said part is behind the first position of said part.

8. An opening system according to claim 1, wherein said completely unfolded fins are held in this position by blocking means.

9. An opening system according to claim 8, wherein said blocking means include a cylindrical surface of said part and the bottom of the block bearing the fins, which work together during the backward movement of the part towards its second position to form two perpendicular surfaces against which two adjacent sides of the base part of the deployed fins get applied.

10. An opening system according to claim 1, wherein the means for the pivoting of the fins consist of a tooth of the base part of the fins, engaged in a peripheral groove of the part when this part is in the first position.

11. An opening system according to claim 1, wherein the second position of the part is determined by the abutment of a truncated shoulder of this part against the base part of the fins, after these fins are blocked in an unfolded position.

12. An opening system according to claim 9, further comprising a mechanical means to block the part in its second position, consisting of at least one flexible strip fixed to the bottom of the block, which gets braced against a shoulder of the rim of the part.

13. An opening system according to claim 1, wherein the means for the pivoting of the fins and the means for blocking the fins in deployed position are designed so as to act during the shifting of the part before it has reached the second position, and wherein the part further has a means to isolate the chamber from a second chamber open on a sensitive ignition device.

* * * * *